United States Patent [19]

Gidge et al.

[11] 4,313,485

[45] Feb. 2, 1982

[54] TRANSPARENT ACCESS CURTAIN FOR COOLERS AND THE LIKE

[75] Inventors: Kenneth N. Gidge, Nashua, N.H.; Henry J. Richard, Lowell, Mass.

[73] Assignee: BSL Corporation, Nashua, N.H.

[21] Appl. No.: 93,193

[22] Filed: Nov. 13, 1979

[51] Int. Cl.[3] ..... A47H 23/01; A47H 23/05; A47H 23/10

[52] U.S. Cl. ..... 160/328; 160/327; 160/332; 160/349 R; 312/297

[58] Field of Search ..... 160/327, 328, 329, 184, 160/332, 349 R, DIG. 8; 312/297; 24/204 R, 31 V

[56] References Cited

U.S. PATENT DOCUMENTS

| | | | |
|---|---|---|---|
| 1,715,286 | 5/1929 | Hardy | 135/14 D |
| 1,726,887 | 9/1929 | Clamp | 160/DIG. 8 |
| 2,041,258 | 5/1936 | Mitchell | 160/DIG. 8 |
| 2,513,846 | 7/1950 | Collins | 248/314 |
| 2,561,611 | 7/1951 | Buchanan | 248/314 |
| 2,708,927 | 5/1955 | Dixon et al. | 160/DIG. 8 |
| 3,241,899 | 3/1966 | Donker | 312/297 X |
| 3,542,445 | 11/1970 | Donker | 312/116 |
| 3,624,814 | 11/1971 | Borichevsky | 160/327 X |
| 3,632,154 | 1/1972 | Woodrich | 160/349 R |
| 4,186,790 | 2/1980 | Schenker et al. | 160/329 |

FOREIGN PATENT DOCUMENTS

| | | | |
|---|---|---|---|
| 1302247 | 7/1962 | France | 160/DIG. 8 |

*Primary Examiner*—Rodney H. Bonck

*Attorney, Agent, or Firm*—Morse, Altman, Oates & Dacey

[57] ABSTRACT

A transparent, flexible curtain with spaced access slits is provided for installation across the opening of display-type, open front and open top coolers, freezers and the like of the sort used in retail food stores. The curtain is comprised of a rectangular sheet of flexible, transparent material secured at one end to the top or rear edge of the cooler cabinet and extending across the cabinet opening. The curtain is formed with a plurality of spaced parallel slits, all extending in the same direction and all originating and terminating within the margins of the sheet. The curtain retains cold air within the refrigerator and allows the food products to be clearly visible to the customer. Goods are removed by the customer reaching through any slit near the product selected. The forward or lower edge of the curtain is weighted in sections to keep the curtain taut across the opening and to allow it to be folded back for loading food into the cooler.

10 Claims, 8 Drawing Figures

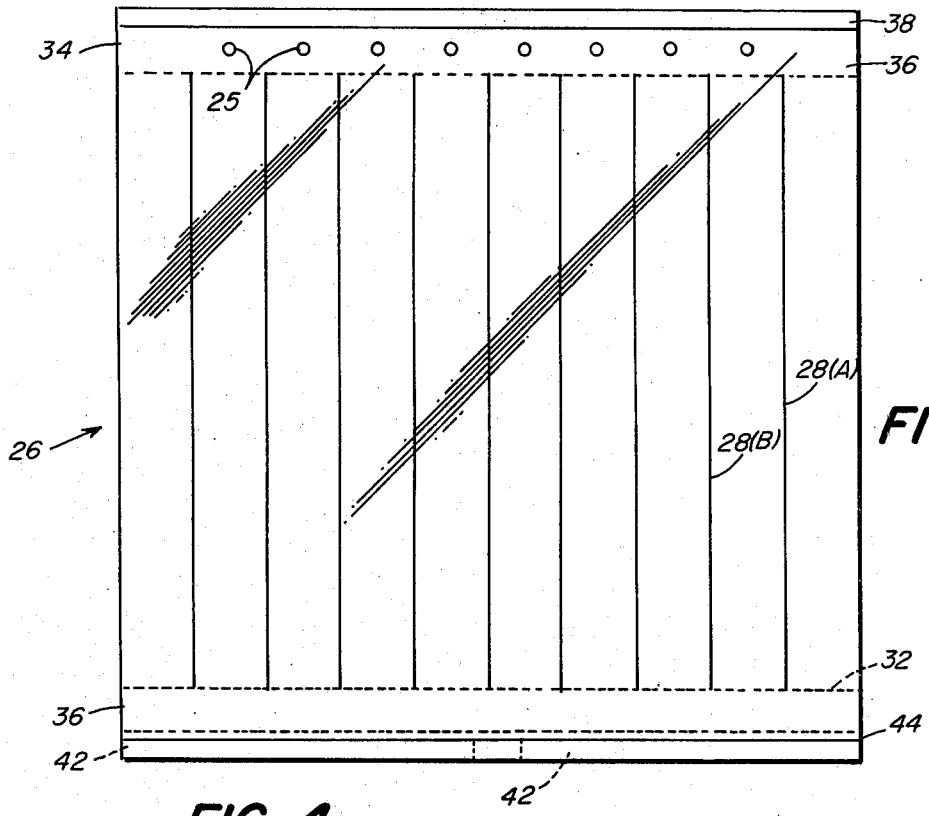
FIG. 1
FIG. 4
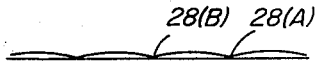
FIG. 6
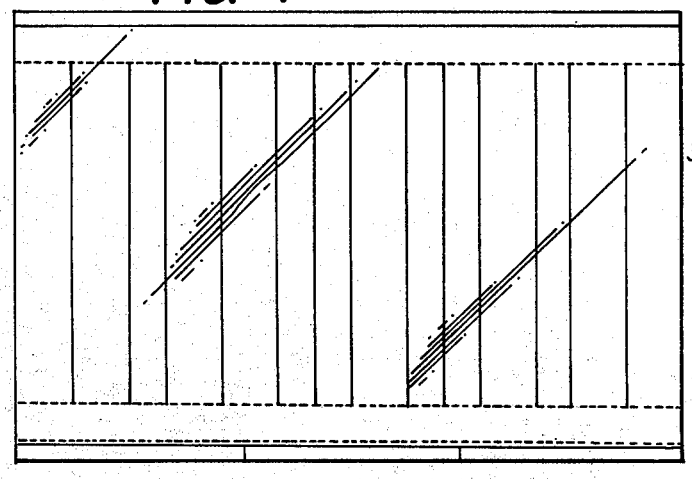
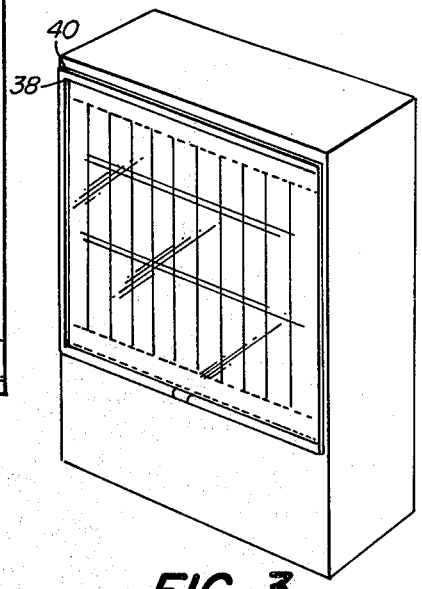
FIG. 3
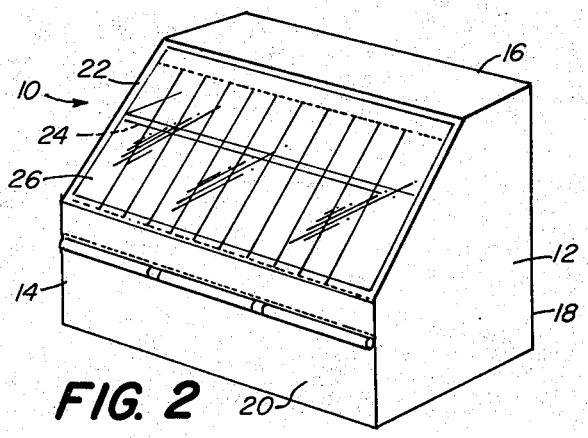
FIG. 2
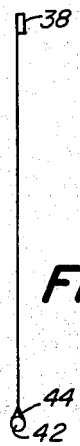
FIG. 5

TRANSPARENT ACCESS CURTAIN FOR COOLERS AND THE LIKE

BACKGROUND OF THE INVENTION

1. Field Of The Invention

This invention relates generally to covers for open front and open top refrigerators, coolers and the like and more particularly is directed towards a flexible access curtain for use on commercial open refrigerators, such as used in retail food stores.

2. Description Of The Prior Art

A great many retail food stores have refrigerators, freezers and coolers in which various types of foods such as dairy produce and frozen foods are stored until purchased by the customer. Because of the need for constant and easy access into such refrigerating chests, particularly in a busy market, many of these units are made with open fronts or open tops which allow the customer to reach directly in and remove whatever item he or she has selected. Refrigerators of this type rely upon the higher density of cold air to retain the chilled air within the chest. While such refrigerators work effectively in keeping the foods chilled, they do require a substantial amount of energy to operate, since the openings in the chest usually run the full length of the unit and are often quite large. Refrigerated air within the unit is continuously lost through natural causes such as drafts, convection, movements of the food products by the customers, etc. This, of course, increases heating costs of the store during cold weather.

While it is possible to install solid doors, either opaque or transparent, on such refrigerators in order to retain cold air, the inconvenience to the customer is objectionable and hinged doors may interfere with traffic flow along narrow store aisles. Also, many customers often leave refrigerator doors ajar so that the function of the door is defeated. It has also been found that transparent doors that are being opened and closed frequently will quickly frost over on the inside so that the refrigerator contents cannot be seen from the outside.

Accordingly, it is an object of the present invention to provide improvements in closures for open-type retail refrigerators. Another object of this invention is to provide a novel access curtain for an open-type refrigerator. A further object of this invention is to provide an energy saving transparent, flexible curtain for an open refrigerator in which the refrigerator contents are readily accessible and the curtain remains essentially closed when the goods are being withdrawn.

SUMMARY OF THE INVENTION

This invention features a curtain for installation across the open top or front of a commercial retail display-type refrigerator, comprising a rectangular sheet of flexible, transparent material detachably connected at one end along the top or rear edge of the refrigerator opening and extending across the cabinet opening. The sheet is formed with a plurality of spaced, parallel, inboard slits, all extending in the same direction to provide access to the cabinet through the curtain. Horizontal rods are attached to the lower edge of the curtain to keep the curtain down tightly across the opening and allow the curtain to be folded back for loading purposes.

BRIEF DESCRIPTION OF THE DRAWINGS

FIG. 1 is a front view of an access curtain made according to the invention, FIG. 2 is a view in perspective of the curtain installed on a typical commercial display refrigerator, FIG. 3 is a view similar to FIG. 2 showing the curtain installed on an upright refrigerator, FIG. 4 is a front view showing a modification of the invention, FIG. 5 is an end view thereof, FIG. 6 is a detailed sectional view showing the shape of the curtain strips.

DETAILED DESCRIPTION OF THE PREFERRED EMBODIMENTS

Figure 7:
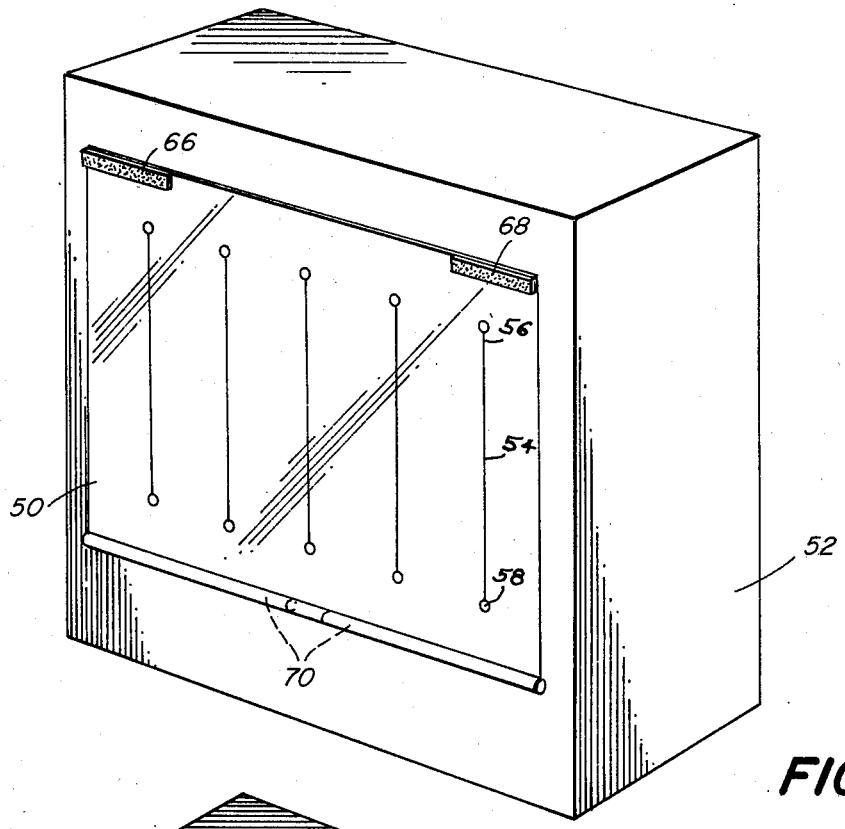
FIG. 7 is a perspective view of another modification of the invention.

Referring now to the drawings and to FIGS. 1 and 2 in particular, the reference character 10 generally indicates a refrigerator unit of the sort commonly employed in retail food markets and adapted to store and display various types of food products such as dairy produce, frozen foods, meats, etc. that must be kept refrigerated. The unit 10 typically is formed with side walls 12 and 14, a relatively narrow top wall 16, a full height rear wall 18, and a relatively short front wall 20. The walls define a housing with an inclined open front 22 providing access to various food items supported on shelves 24. Typically, the refrigeration mechanism is located within the housing unit 10 and circulates cold air through the storage portion of the chest.

The opening 22 generally is quite large and typically extends the full width of the unit and a substantial portion of the height thereof, so that all shelves and bins are freely accessible to the customers. In practice, the refrigerator opening 22 is left fully open during normal business hours although it may be covered by a tarpaulin, or the like, when the store is closed. With the refrigerator unit 10 open, a substantial amount of energy is required to keep the food produce at the proper temperature because of the large losses of chilled air through the opening 22.

In accordance with the present invention, a flexible, transparent curtain, generally indicated by the reference character 26, is provided across the opening 22. The curtain 16 is comprised of a single rectangular sheet attached at its upper end to the upper wall 16 along the edge of the opening 22 and extending down over the opening 22 to drape across the upper edge of the front wall 20. The size of the sheet is sufficient to cover the opening 22 with a slight overlap.

The curtain is formed with a plurality of spaced parallel slits 28(A), 28(B) etc. defining self-closing access openings through the curtain. The openings are self-closing by virtue of the fact that the slits originate and terminate within the margins of the curtain and do not extend to either edge thereof. In the preferred embodiment the slits are straight and extend vertically of the curtain. Typically, all of the slits are spaced about 3" apart although this obviously may be varied through a wide range, up to perhaps 2', for example, or the slit spacings may alternate from wide to narrow, as suggested in FIG. 4.

In any event all of the slits 28 are of the same length and terminate at their upper ends and at their lower ends at a horizontal stitch line 32 to define upper and lower border portions 34 and 36, respectively. The upper border 34 preferably is formed with a group of perforations 25 which serve as vents through the curtain for heat produced by the refrigeration machinery and released at the top of the unit.

The curtain may be made up in a wide variety of widths and lengths with typical dimensions being on the order of perhaps 4½' in width and a length of perhaps 5½' depending upon the size of the opening as well as the number of access points desired through the curtain. These dimensions are only by way of example and can be increased or decreased according to particular requirements. Various plastic sheet material may be used and should be transparent, relatively flexible, stable and durable and not readily subject to cracking from cold or abrasion which may tend to impair the transparency of the panels.

The curtain may be attached to the chest by various means such as detachable fasteners of the sort sold under the trademark Velcro or the like which allow the curtain to be fully or partially detached for cleaning or replacement, or for restocking the refrigerator, as required. One part of the Velcro strip, indicated at 38, is applied to the inner upper edge of the curtain while the other part 40 is applied to the chest above the opening 22. Plastic such as vinyl, polyethylene, or the like may be used to fabricate the curtain and clear polyethylene vinyl is particularly suitable for this purpose. The material may be provided in various thicknesses from a relatively thin gauge of about 6 mils up to perhaps 50 gauge material, for example.

It has been found that when the sheet of flexible plastic material used for the curtain is slit in the manner described, the vertical strips between each pair of slits curl slightly. The curling results in a plurality of strips that in transverse cross-section are shallow, semi-tubes best shown in FIG. 6.

The semi-tubular strips not only provide some longitudinal rigidity to each flexible strip so as to prevent the curtain from draping excessively into the refrigerator opening 22, but also facilitates access through the slits. A customer wishing to purchase an item of food 24 within the case, simply inserts his hand through a slit near the selected food item. The curvature of the strips on either side of the slit allows a customer to insert his or her hand smoothly through the curtain and withdraw it with the article 24.

The lower end of the curtain should overhang the upper edge of the front wall 20 by several inches in order to allow the curtain to move in and out to some extent as a result of customers reaching through the curtain and displacing it to some extent. In order to improve the hang of the curtain, the lower end of the curtain is provided with weights such as sections of metal pipe, steel bars or rods 42 mounted in a sleeve 44 formed along the lower edge of the curtain. The weight of the rods provides increased tension to the curtain to ensure that the curtain remains in proper position across the opening despite frequent displacement by customers. Typical dimensions of the bars 42 are ⅛"-×1½"×23".

The bottom hem of the curtain forming the sleeve 44 should be turned to the inside of the curtain so that any condensation on the outside of the curtain will run off the bottom of the curtain rather than collect in the sleeve and cause rusting of the weight.

By using two or more lengths of rods 42 rather than a single piece extending the full width of the curtain, a stockboy can readily fold either end of the curtain back in order to restock the shelves in the unit through a large opening rather than through the curtain slits. The rods 42 should be spaced slightly apart in end-to-end relation to allow the curtain to be folded conveniently at spaces between the ends of the rod. The upper edge of the curtain may be partially detached by peeling apart the Velcro connectors above the section of curtain to be folded back. Once the unit has been restocked, the curtain is closed by re-attaching the Velcro fasteners and folding that section of curtain back in place.

Figure 8:
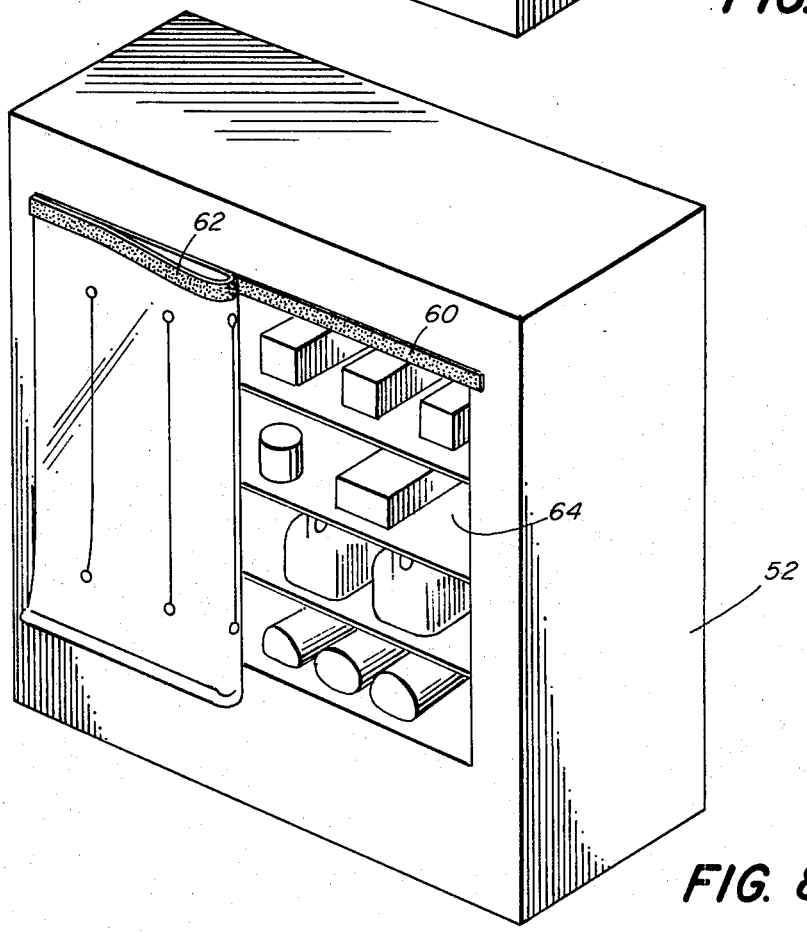
FIG. 8 is a perspective view showing the curtain of FIG. 6 in a folded position.

Referring now to FIGS. 7 and 8 of the drawings, there is illustrated a further modification of the invention, and, in this embodiment a curtain 50 adapted to be hung over the front of a cabinet 52 is formed with a plurality of spaced, parallel slits 54. The upper and lower ends of the slits terminate in circular holes 56 and 58, typically ¼" in diameter and formed by punching or the like. The holes at the ends of the slits have been found effective in resisting against tearing of the curtain material.

The curtain is attached to the top of the cabinet 52 by means of Velcro strips 60,62, one part 60 attached to the cabinet above a front opening 64 and the other part 62 attached along the upper inner margin of the curtain. The front of the curtain is also provided with short sections 66, 68 of Velcro at the upper corners thereof. One section is hooked while the other is felt whereby the curtain may be peeled back as suggested in FIG. 8 for loading and unloading the cabinet. In such event the upper adjacent corners of the curtain are pressed together and held by the Velcro sections 66 and 68 until the curtain is to be returned to its closed position. Typically, the sections 66 and 68 are about 3" long. Short sections of weights 70 along the bottom of the curtain allow the curtain to be folded in the manner shown.

While the invention has been described with particular reference to the illustrated embodiments, numerous modifications thereto will appear to those skilled in the art.

Having thus described the invention, what we claim and desire to obtain by Letters Patents of the United States is:

1. An access curtain for use over the opening in an open display-type refrigerator, or the like, comprising (a) a unitary sheet of flexible, transparent material of generally rectangular outline connectable along its upper edge to said refrigerator proximate to the upper edge of said opening and of a length sufficient to span said opening and overhang the lower edge of said opening, (b) said sheet being formed with a plurality of spaced parallel vertical slits entirely within the outer edges of said sheet and extending over a substantial portion of the curtain length to form a plurality of coplanar parallel integral strips sections arranged in abutting edge to edge relation, and, (c) weight means connected along the lower edge of said sheet.

2. An access curtain according to claim 1 wherein said slits are all of equal length.

3. An access curtain according to claim 1 wherein said weight means includes an elongated metal member, said sheet being formed with a sleeve along the lower margin of said sheet and said member is mounted in said sleeve.

4. An access curtain according to claim 1 including detachable fastening means connecting said sheet to said refrigerator.

5. An access curtain according to claim 4 wherein said fastening means include a strip of felt material and a strip of flexible hooked material.

6. An access curtain according to claim 1 wherein said curtain is formed with a plurality of vent holes adjacent the upper margin thereof.

7. An access curtain according to claim 1 wherein said weight means includes a plurality of elongated metal members, said sheet being formed with a sleeve along the lower margin of said sheet and said members are mounted in said sleeve in slightly spaced, end-to-end relation.

8. An access curtain according to claim 7 including detachable fastening means connecting said sheet to said refrigerator.

9. An access curtain according to the claim 1 wherein said sheet is formed with a circular opening at each end of each slit.

10. An access curtain according to claim 1 including cooperating detachable fastening means at both upper adjacent corners and outer face of said sheet whereby said sheet may be partially separated from said refrigerator at either upper corner and folded back against itself from either upper corner and the upper adjacent corners held together by said fastening means.

* * * * *